United States Patent [19]

McNulty

[11] Patent Number: 4,813,499

[45] Date of Patent: Mar. 21, 1989

[54] MOVABLE MOUNT CONCRETE DRILL

[76] Inventor: Kenneth McNulty, 1855 N. Cymbal Pl., Anaheim, Calif. 92807

[21] Appl. No.: 212,920

[22] Filed: Jun. 20, 1988

[51] Int. Cl.[4] ..... E21B 7/02

[52] U.S. Cl. ..... 175/122; 175/62; 175/162; 175/170; 175/203; 173/22

[58] Field of Search ..... 175/162, 170, 202, 203, 175/220, 62, 122; 173/22, 23, 28, 42, 18, 170; 299/39

[56] References Cited

U.S. PATENT DOCUMENTS

| | | | |
|---|---|---|---|
| 2,578,033 | 12/1951 | Austin et al. | 175/170 X |
| 2,668,690 | 2/1954 | Cameron | 173/42 X |
| 3,367,427 | 2/1968 | Baumgardner | 173/22 |
| 4,441,564 | 4/1984 | Castillo | 175/62 X |
| 4,589,499 | 5/1986 | Behrens | 173/22 |
| 4,671,365 | 6/1987 | Back et al. | 175/170 X |
| 4,703,811 | 11/1987 | Lam | 175/162 X |

*Primary Examiner*—Stephen J. Novosad

[57] ABSTRACT

A mechanical concrete drill system is provided which is capable of drilling holes in concrete curbs, walls, and the like, while being permanently mounted to a truck. A hydraulic lift system contained in the truck moves the drill system vertically, so that the drill can be operated in various vertical positions. The drill system is conveniently stored in the truck for movement to other drill sites.

1 Claim, 2 Drawing Sheets

FIG. 1
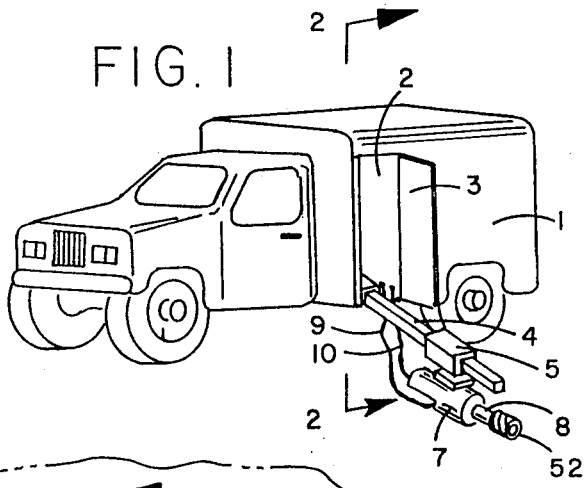
FIG. 4
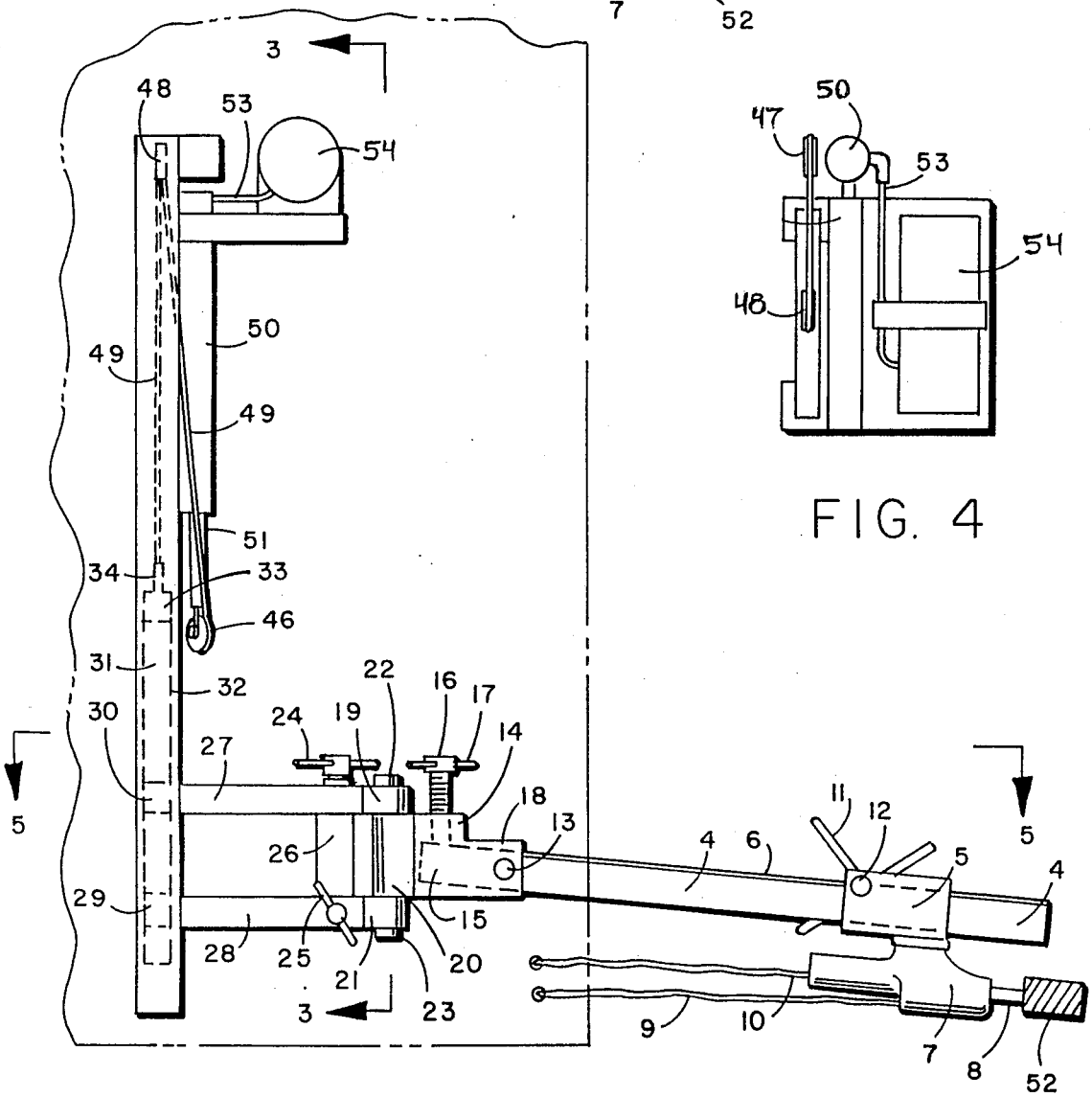
FIG. 2

MOVABLE MOUNT CONCRETE DRILL

INTRODUCTION AND BACKGROUND

The invention relates to a concrete drilling apparatus utilized for drilling holes in various structures in the field, including holes in curbs, concrete walls, and the like.

Various drills have been devised for drilling holes in curbs, walls and other structures. The drills are generally transported to the field in a truck, or other transporting medium, and completely removed from the truck for use in the field. The drills are supported on a drill track. The operator, after removing the drill system from the truck, commences the operation. In such prior art devices, various vertical positions can only be ascertained either by hand, or by various cumbersome methods, such as attachment of the drill to the drilled structure prior to the drilling operation. Such prior art drilling devices are difficult to operate, and also result in waste of man power in the removal of the drill from the truck, and in the time spent setting up the system and moving the drill to various vertical positions.

There exists a need for a device whereunder the industrial drill can be readily stored and mounted in the transporting vehicle for use in the field drilling operation. Furthermore, there exists a need for a drilling system which can be moved vertically by mechanical means while mounted on a truck or other transporting medium.

Accordingly, one object of the invention is to provide a device to mount a concrete drill system to the truck for use in the drilling operation. Another object of the invention is to provide a vertical lift contained in such truck so that the concrete drill can be moved vertically during the drilling operation. Other objects of the invention will be apparent from the description which follows.

DRAWINGS

FIG. 1 shows a perspective view of the invention.

FIG. 2 shows a side view of the invention, depicting the details of the hydraulic transport and lift system.

FIG. 4 shows a detailed schematic of the hydraulic transport system.

DETAILED DESCRIPTION OF THE INVENTION

Figure 5:
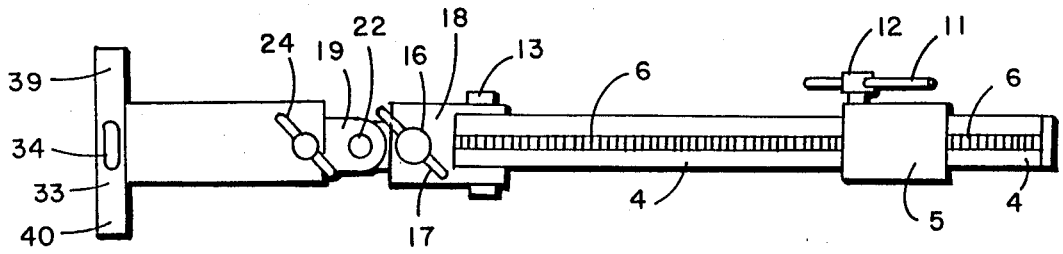
FIG. 5 shows a top view portion of the drill guide track and connecting means to the hydraulic lift system.

FIG. 1, shows the drilling device extending from truck 1. The drilling system can be stored within compartment 2 of truck 1 while being transported to the drill site. Upon arrival at the drill site, door 3 is opened and the drill system is removed from compartment 2. While being stored in compartment 2, the drill system, which includes guide track 4 plus speed drill 7 and the other associated parts, are stored vertically in compartment 2. The drill system is utilized in a horizontal position during the drilling operation.

FIG. 1 shows a drill carriage 5 contained on a guide track 4. As will be explained hereinafter, the drill carriage is moved horizontally along the guide track 4. There is shown a speed drill 7 supported by the drill carriage 5. Protruding from the speed drill 7 is a drill shaft 8. Attached to such shaft 8 is a drill bit 52, which pierces the concrete of the curb or other vertical body to be drilled. Electricity is provided to the speed drill 7 by line 10, which is attached to batteries in truck 1. Hose 9 serves to transport water from a water storage tank in truck 1 to the drill speed for cooling purposes.

FIG. 2 shows a side view of the details of the invention, including the drill system previously described, and a hydraulic lift system contained in compartment 2 of truck 1. As indicated hereinabove, the speed drill 7 is supported by drill carriage 5, which in turn rests upon a guide track 4. Handle 11 can be utilized by the operator to move the drill carriage 5 horizontally along with guide track 4. Referring now to FIG. 5, there are numerous teeth 6 contained on guide track 4. Gears within the drill carriage 5 mesh with such teeth 6. Rotation of handle 11 thus moves drill carriage 5 horizontally along the guide track 4. During the actual drilling operation, the operator moves the drill carriage 5 horizontally for penetration of the drill bit 52 into the concrete.

The guide track 4 can be placed in various slanted positions utilizing handle 16. As handle 16 is tightened, pressure is placed on the back portion 15 of the guide track 4, thus altering the angle of guide track 4.

Guide track 4 can be placed in a vertical position by rotating guide track 4 about pin 13. When it is desired to stop the drilling apparatus, the operator places the guide track in a vertical position within compartment 2.

It may be desirable to move the drilling device in various lateral positions during the drilling operations. There is provided nuts 22 and 23 shown connected to post 21. Support plate or section 14 can be rotated about screwed post 21. Thus, the guide track is moved laterally.

The most important feature of the invention is the inclusion of a vertical lift, contained within the truck, whereby the drilling apparatus can be moved at various vertical positions during the drilling operation so that the drill bit 52 can drill holes at various vertical points in the curb or wall concrete structure. Naturally, the truck can be moved horizontally or laterally so that holes can be drilled at various points horizontally along the curb or concrete structure. Inclusion of the vertical lift system allows holes to be drilled at various vertical positions. Accordingly, the drill system need not be physically removed from the truck, but can be operated while mounted in the truck or transport medium resulting in a less burdensome operation, and resulting in substantial labor savings.

FIG. 2 shows horizontal sections 27 and 28 connected to nuts 22 and 23. Nuts 22 and 23 are in intimate contact with welded sections 20 and 14. Horizontal sections 27 and 28 are welded at positions 30 and 29, respectively, to the vertical lift member 31. Accordingly, when vertical lift member 31 is moved upwards, sections 27 and 28 and, hence, the entire drilling device, is likewise moved upwards.

Figure 3:
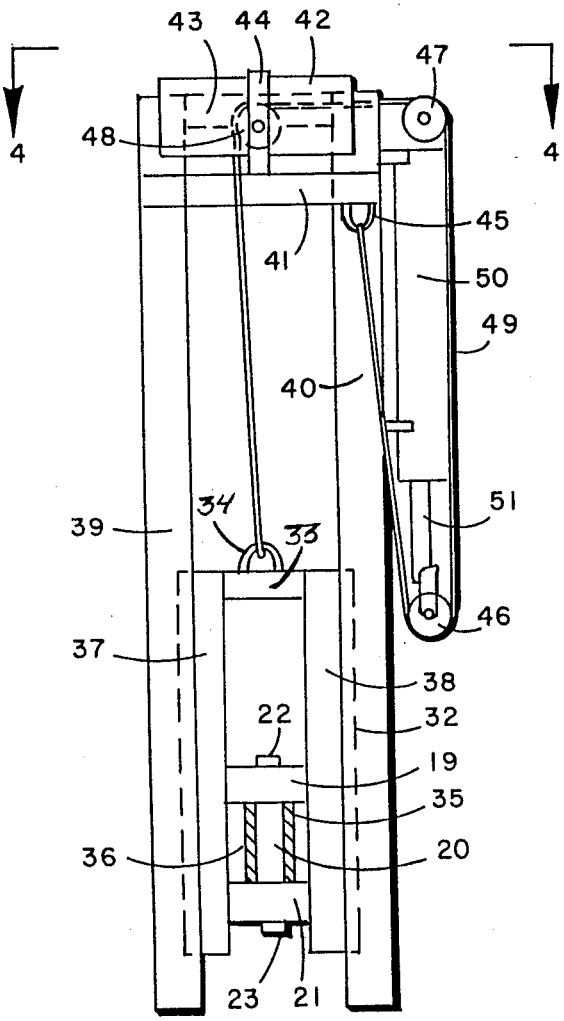
FIG. 3 shows a front view of the details of the hydraulic removal and transport system.

Referring now to FIG. 3, bolts 19 and 21 are shown welded to vertical members 37 and 38. Sections 37 and 38 are contained within vertical channel steel members 39 and 40 and are movable vertical therein. There is a horizontal member 33 shown attached to vertical members 37 and 38. Welded to horizontal member 33 is a hook 34 which supports cable 49. Thus, there is provided a vertical lift "T" composed of members 37, 38, and 33 contained within the channel of steel members 39 and 40. When cable 49 is lifted upwards, the vertical lift "T" is thus lifted upwards within the channel of steel members 39 and 40. Upon upward vertical movement of vertical lift "T", members 27 and 28 shown in FIG. 2 are likewise ,moved upwards, which, in turn, lifts the entire drill system. Cross support member 41 and a vertical support member 44 are shown. An outer plate member 42 and an inner plate member 43 are also shown.

The hydraulic lift system is depicted in FIGS. 2 and 3. FIG. 2 shows a pump and storage tank. 54. Hydraulic fluid is pumped through line 53 into hydraulic cylinder 50. Within the hydraulic cylinder 50, and movable in and out thereof is a hydraulic cylinder shaft 51. Connected to hydraulic cylinder shaft 51 is pulley 46. As hydraulic fluid is pumped into cylinder 50, shaft 51 is displaced downwards, thus moving pulley 46 downwards. Steel cable 49 is held in place by hooks 34 and 45 shown in FIG. 3. Cable 49 rotates about pulleys 46, 47 and 48, as shown in FIG. 3. As pulley 46 is displaced downwards, hook 34 is lifted upwards, thus lifting the vertical "T" member 37, 38, and 33. When the hydraulic cylinder is depressurized, hook 34 moves downwards resulting in downward movement of the vertical "T" member, and likewise downward movement of the drilling system.

The above-described hydraulic system, as well as the vertical lift system, is contained within the truck 1 and affixed thereto.

FIG. 5 shows a top view of the drill carriage, together with the various handle portions of the drilling system. Guide track 4 is shown containing various teeth 6, so that the carriage 5 can be moved horizontally utilizing gear members contained therein. As handle 11 is rotated, the gear meshes with teeth 6 for horizontal movement of the carriage 5. Support bolts 19 are shown. A handle 24 is also shown.

After completion of the drilling operation, the operator rotates the drilling apparatus to a vertical position, as explained hereinabove, and the guide track, along with the drill carriage, speed drill and associated elements, are contained in compartment 2 in a vertical position. Compartment door 3 is enclosed and the drilling apparatus is transported to the next drilling location.

I claim:

1. A mechanical concrete drilling system for the drilling of a curb or other vertical concrete structure while being attached to a truck, comprising:

(a) a drill;

(b) a drill shaft extending from such drill;

(c) a drill bit connected to the exterior of such drill shaft;

(d) a drill carriage supporting said drill;

(e) a drill track supporting said drill carriage, and containing numerous track teeth in communication with a gear contained in said drill carriage;

(f) a vertical lift means;

(g) means to connect said drill track to said vertical lift means;

(h) said vertical lift means being connected to two vertical channel structures;

(i) a hydraulic pump system comprising a hydraulic pump, hydraulic chamber and hydraulic shaft;

(j) pulley means having at least one pulley connected to said hydraulic shaft;

(k) a cable connected to or in communication with said vertical lift means, and in communication with said pulley means;

(l) means for moving said vertical lift means upwards and downwards, utilizing said hydraulic pump system.

* * * * *